US009574495B2

(12) United States Patent
Matsuda et al.

(10) Patent No.: US 9,574,495 B2
(45) Date of Patent: Feb. 21, 2017

(54) VARIABLE COMPRESSION RATIO DEVICE FOR INTERNAL COMBUSTION ENGINE

(71) Applicants: MITSUBISHI JIDOSHA KOGYO KABUSHIKI KAISHA, Tokyo (JP); MITSUBISHI JIDOSHA ENGINEERING KABUSHIKI KAISHA, Okazaki-shi, Aichi (JP)

(72) Inventors: Seiji Matsuda, Anjo (JP); Hirofumi Higashi, Okazaki (JP); Akira Mikita, Anjo (JP)

(73) Assignees: Mitsubishi Jidosha Kogyo Kabushiki Kaisha, Tokyo (JP); Mitsubishi Jidosha Engineering Kabushiki Kaisha, Aichi (JP)

( * ) Notice: Subject to any disclaimer, the term of this patent is extended or adjusted under 35 U.S.C. 154(b) by 113 days.

(21) Appl. No.: 14/581,713

(22) Filed: Dec. 23, 2014

(65) Prior Publication Data

US 2015/0176483 A1 Jun. 25, 2015

(30) Foreign Application Priority Data

Dec. 25, 2013 (JP) ..... 2013-268017

(51) Int. Cl.
*F02B 75/04* (2006.01)

(52) U.S. Cl.
CPC ..... *F02B 75/045* (2013.01); *F02B 75/048* (2013.01)

(58) Field of Classification Search
CPC ..... F02D 15/02; F02D 15/00; F02B 75/044; F02B 75/04; F02B 75/045
USPC ..... 123/48 R, 48 A, 48 AA, 48 B, 48 C, 78 R,123/78 A, 78 AA, 78 B, 78 BA
See application file for complete search history.

(56) References Cited

U.S. PATENT DOCUMENTS

| | | | | |
|---|---|---|---|---|
| 460,642 A | | 10/1891 | Kitson | |
| 2,427,668 A | | 9/1947 | Gill | |
| 5,146,879 A | * | 9/1992 | Kume | F01M 1/06 123/48 B |

(Continued)

FOREIGN PATENT DOCUMENTS

| | | |
|---|---|---|
| EP | 0 297 904 A2 | 1/1989 |
| FR | 2 882 575 A1 | 9/2006 |

(Continued)

OTHER PUBLICATIONS

Extended European Search Report issued May 4, 2015 in corresponding European Application No. 14199850.0.

*Primary Examiner* — Long T Tran
(74) *Attorney, Agent, or Firm* — Birch, Stewart, Kolasch & Birch, LLP

(57) ABSTRACT

A variable compression ratio device for an internal combustion engine includes: a connecting rod, having a small end and a large end, wherein a support hole formed at the small end is pivotally supported by a support shaft of a piston that reciprocates in a cylinder, and a support hole formed at the large end is pivotally supported by a support shaft of a crankshaft; an eccentric sleeve that is rotatably installed between the support hole of the small end or the support hole of the large end and the support shaft, and displaces a center axis of the support hole of the small end or a center axis of the support hole of the large end with respect to a center axis the support shaft; and an actuator that drives and rotates the eccentric sleeve.

5 Claims, 7 Drawing Sheets

(56) References Cited

U.S. PATENT DOCUMENTS

| | | | | |
|---|---|---|---|---|
| 6,394,047 | B1 * | 5/2002 | Rao | F02B 75/045 123/48 B |
| 6,412,453 | B1 * | 7/2002 | Rao | F02B 75/045 123/48 B |
| 6,497,203 | B1 * | 12/2002 | Rao | F02B 75/045 123/48 B |
| 6,499,446 | B1 * | 12/2002 | Rao | F02B 75/045 123/48 B |
| 6,622,669 | B1 * | 9/2003 | Nageswar Rao | F02B 75/045 123/48 B |
| 6,668,768 | B2 * | 12/2003 | Styron | F02D 15/02 123/48 B |
| 6,705,255 | B2 * | 3/2004 | Papaioannou | F02B 75/04 123/48 R |
| 7,946,260 | B2 * | 5/2011 | von Mayenburg | F02D 15/02 123/48 B |
| 2008/0184966 | A1 | 8/2008 | Marchisseau | |
| 2013/0247879 | A1 | 9/2013 | von Mayenburg | |

FOREIGN PATENT DOCUMENTS

| | | | |
|---|---|---|---|
| GB | 473887 | A | 10/1937 |
| GB | 2 251 456 | A | 7/1992 |
| JP | 6-241058 | A | 8/1994 |
| JP | 2000-64866 | A | 2/2000 |
| WO | WO 2007/043093 | A1 | 4/2007 |
| WO | WO 2014/162043 | A1 | 10/2014 |

* cited by examiner

OPEN
CLOSE
11
11a
11b
12
13
13a
13b
15
16
17
21
22
5
6

VARIABLE COMPRESSION RATIO DEVICE FOR INTERNAL COMBUSTION ENGINE

BACKGROUND

The present invention relates to a variable compression ratio device for an internal combustion engine.

Disclosed is a variable compression ratio device for an internal combustion engine which can change a compression ratio in order to achieve high efficiency and low fuel consumption. For example, in the variable compression ratio device, an eccentric sleeve is rotatably inserted between a large end of a connecting rod and a crank pin of a crankshaft, and the eccentric sleeve rotates due to the rotation of the crankshaft. The position of the crank pin with respect to a support hole of the connecting rod is changed due to the rotation of the eccentric sleeve, and the compression ratio switches between a high compression ratio and a low compression ratio (for example, refer to Patent Documents 1 and 2).

The rotation position of the eccentric sleeve is fixed to a predetermined rotation position using a stopper or the like that is mechanically operated so as to fix the compression ratio. In addition, the rotation position of the eccentric sleeve is fixed by increasing the frictional force of the eccentric sleeve with respect to the support hole of the connecting rod using oil pressure.

However, since the rotation of the eccentric sleeve is dependent on the rotation of the crankshaft (operation of the internal combustion engine), the eccentric sleeve rotates in one direction, and is likely to be subjected to inertial force. In addition, the rotational speed of the eccentric sleeve changes due to combustion pressure. For this reason, there is a problem in that the rotation position of the eccentric sleeve cannot be accurately fixed because responsiveness in fixing the rotation position changes when the rotation position of the eccentric sleeve is fixed and thus the compression ratio is fixed.

[Patent Document 1] JP-A-6-241058

[Patent Document 2] JP-A-2000-64866

SUMMARY

The present invention is made in light of the problem, and an object of the present invention is to provide a variable compression ratio device for an internal combustion engine which can reliably control the rotation position of an eccentric sleeve to be in a desired rotation position.

According to an advantageous aspect of the invention, there is provided a variable compression ratio device for an internal combustion engine comprising:

a connecting rod, having a small end and a large end, wherein a support hole formed at the small end is pivotally supported by a support shaft of a piston that reciprocates in a cylinder, and a support hole formed at the large end is pivotally supported by a support shaft of a crankshaft;

an eccentric sleeve that is rotatably installed between the support hole of the small end or the support hole of the large end and the support shaft, and displaces a center axis of the support hole of the small end or a center axis of the support hole of the large end with respect to a center axis the support shaft; and an actuator that drives and rotates the eccentric sleeve.

The actuator may include an pressure oil chamber that is formed between the small end or the large end of the connecting rod, and the eccentric sleeve; and a transmitting unit for transmitting oil pressure applied to the pressure oil chamber to the eccentric sleeve. The variable compression ratio device may further comprise a control unit for controlling the rotation of the eccentric sleeve by controlling the oil pressure applied to the pressure oil chamber.

The eccentric sleeve may be disposed between the support hole of the large end of the connecting rod and the support shaft of the crankshaft.

The pressure oil chamber may be formed in the support hole of the large end of the connecting rod.

DETAILED DESCRIPTION OF EXEMPLIFIED EMBODIMENTS

A variable compression ratio device for an internal combustion engine according to an embodiment of the present invention will be described with reference to FIGS. 1 to 3B.

Figure 1:
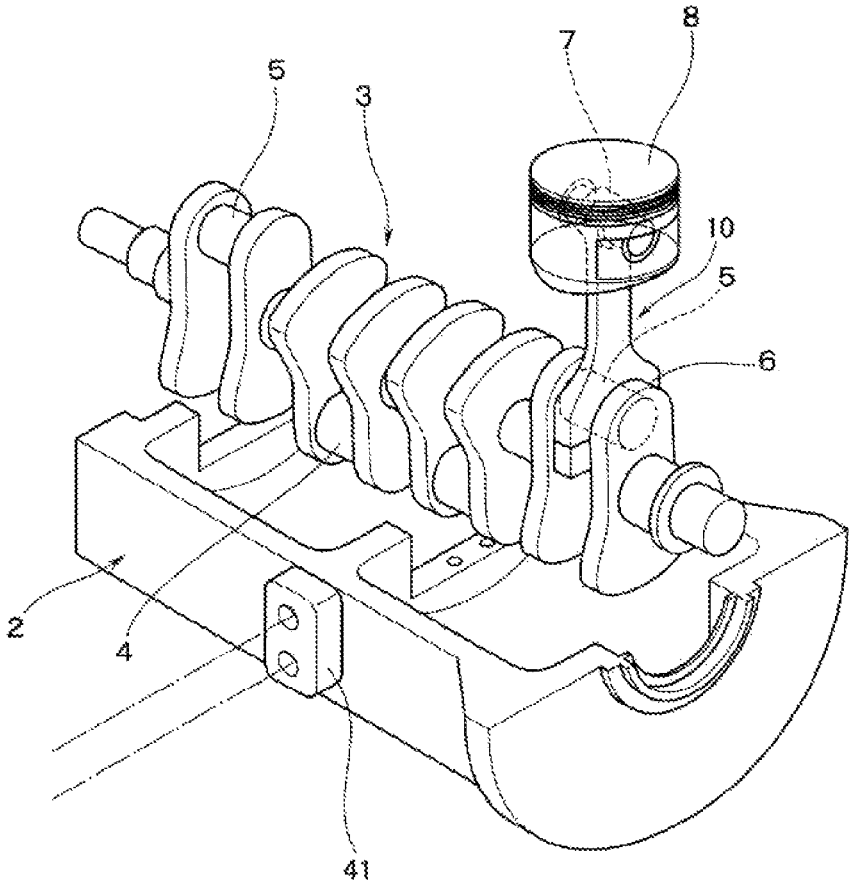
FIG. 1 is a view illustrating the exterior of main portions of a variable compression ratio device for an internal combustion engine according to the embodiment of the present invention.
Figure 2:
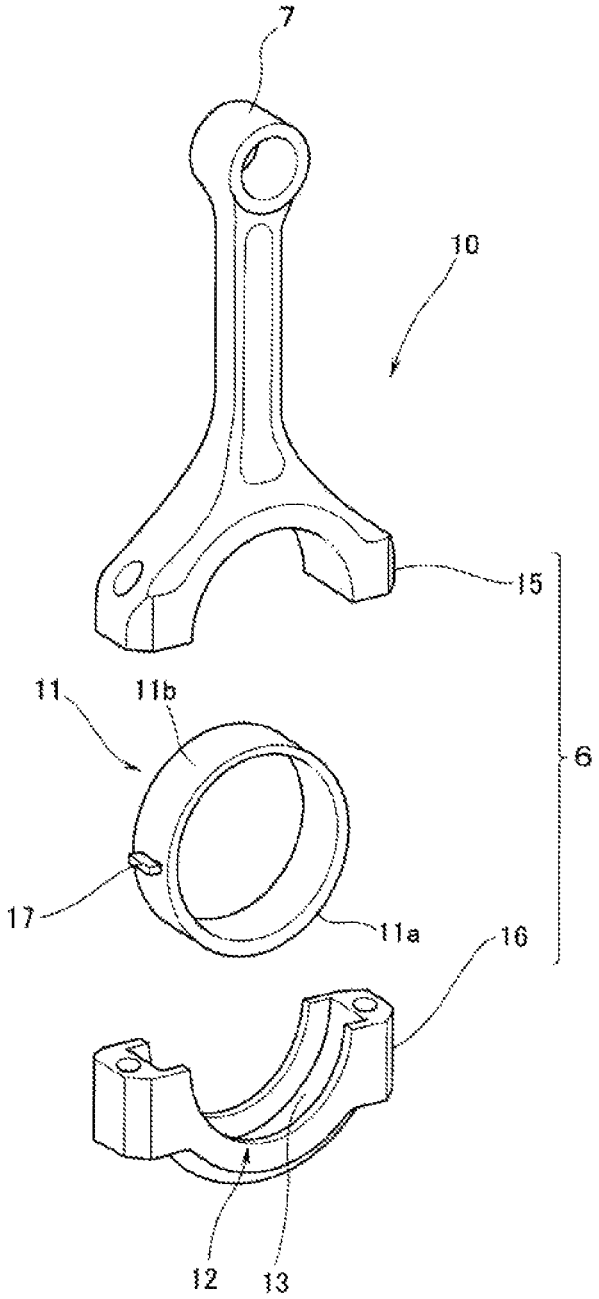
FIG. 2 is an exploded perspective view of a connecting rod.
Figure 3A:
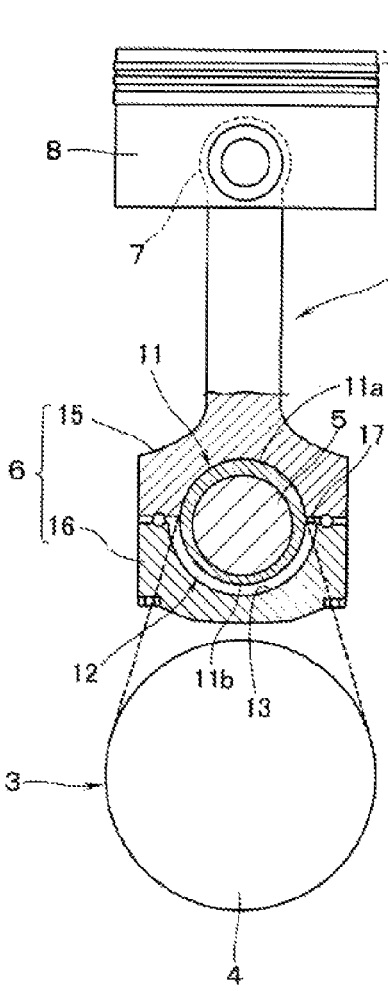
FIG. 3A is a cross-sectional view of the connecting rod at a high compression ratio.
Figure 3B:
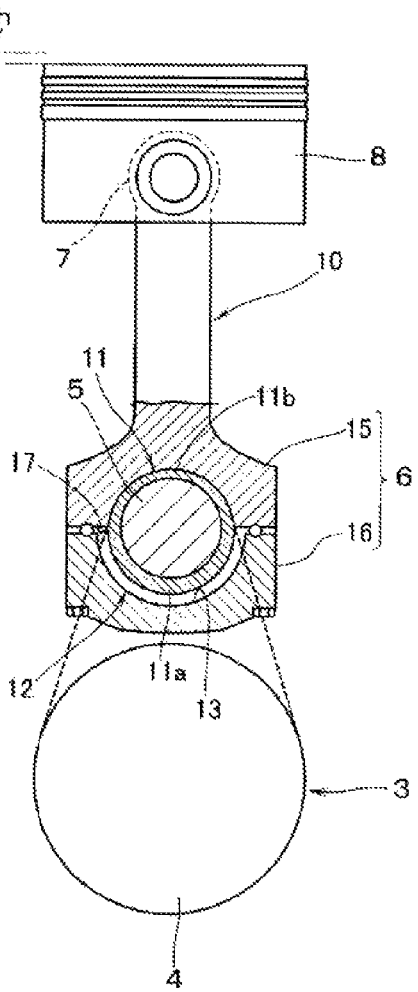
FIG. 3B is a cross-sectional view of the connecting rod at a low compression ratio.

FIG. 1 is a view illustrating the exterior of main portions of the variable compression ratio device for an internal combustion engine according to the embodiment of the present invention. FIG. 2 is an exploded exterior view of a connecting rod. FIG. 3A is a cross-sectional view of the connecting rod at a high compression ratio, and FIG. 3B is a cross-sectional view of the connecting rod at a low compression ratio.

As illustrated in FIG. 1, a crank journal 4 of a crankshaft 3 is rotatably supported by a cylinder block (FIG. 1 illustrates only a lower block 2) of the internal combustion engine.

As illustrated in FIGS. 1 and 2, a large end 6 of a connecting rod 10 is rotatably supported by a crank pin (support shaft) 5 of the crankshaft 3. That is, a support hole of the large end 6 of the connecting rod 10 is pivotally supported by the support shaft. A small end 7 of the connecting rod 10 rotatably supports a support shaft of a piston 8 that reciprocates in a cylinder. That is, the support shaft of the piston 8 pivotally supports a support hole of the small end 7 of the connecting rod 10.

The reciprocating motion of the piston 8 in the cylinder rotates the crankshaft 3 about the crank journal 4 via the connecting rod 10. That is, the reciprocating motion of the piston 8 is transformed into the rotating force of the crankshaft via the connecting rod 10.

An outer circumferential surface of an eccentric sleeve 11 is rotatably supported by the support hole of the large end 6 of the connecting rod 10, and an inner circumferential surface of the eccentric sleeve 11 is rotatably supported by an outer circumferential surface of the crank pin 5 of the crankshaft 3. A thick wall portion 11*a* and a thin wall portion 11*b* of the eccentric sleeve 11 are provided to face each other in a circumferential direction, and the wall thickness of each of the thick wall portion 11*a* and the thin wall portion 11*b* changes gradually.

An actuator 12 is built in the large end 6 of the connecting rod 10, and is driven and rotates the eccentric sleeve 11. The center of the crank pin 5 of the crankshaft 3 becomes eccentric with respect to the center of the large end 6 of the connecting rod 10 due to the rotation of the eccentric sleeve 11 by the actuator 12, and the position of the piston 8 (refer to FIG. 1) is switched to a position for the high compression ratio or a position for the low compression ratio to be realized, which will be described in detail.

That is, a high compression ratio operation is beneficial to an improvement in thermal efficiency and fuel economy, and in contrast, a high load operation at the high compression ratio may cause knocking. Therefore, primarily, a high compression ratio operation is required to run under low load conditions. For this reason, as illustrated in FIGS. 3A and 3B, when the actuator 12 is driven and rotates the eccentric sleeve 11 depending on the operation state, the compression ratio switches between the high compression ratio and the low compression ratio.

As illustrated in FIG. 3A, when the rotation position of the eccentric sleeve 11 is set in such a manner that the thick wall portion 11*a* is positioned on an upper side, the compression ratio becomes the high compression ratio. As illustrated in FIG. 3B, when the rotation position of the eccentric sleeve 11 is set in such a manner that the thin wall portion 11*b* is positioned on the upper side, the compression ratio becomes the low compression ratio.

That is, in a high compression ratio state in which the thick wall portion 11*a* of the eccentric sleeve 11 is positioned on the upper side as illustrated in FIG. 3A, the top dead center of the piston 8 is positioned (moves) by a height of h higher than that in a low compression ratio state in which the thin wall portion 11*b* of the eccentric sleeve 11 is positioned on the upper side as illustrated in FIG. 3B.

For example, when the engine is switched from a high compression ratio state to a low compression ratio state, which means a change from a low load operation to a high load operation, because the low compression ratio is set for a high load operation, high responsiveness is required.

For this reason, when the engine is switched from a high compression ratio state to a low compression ratio state, the eccentric sleeve 11 rotates in the direction of the action of a rotating force of the crankshaft 3, and the eccentric sleeve 11 rotates at a high response speed. When the engine is switched from a low compression ratio state to a high compression ratio state, high responsiveness is not required, and thereby the drive range of the actuator 12 is not increased more than necessary, and the eccentric sleeve 11 rotates in the opposite direction of the rotation direction of the crankshaft 3.

Since the actuator 12 is driven and rotates the eccentric sleeve 11, it is possible to reliably control the rotation position of the eccentric sleeve 11 to be in a desired rotation position.

Hereinafter, specifically, a control unit for controlling the actuator 12 and the rotation of the eccentric sleeve 11 will be described with reference to FIGS. 2, 4, and 5.

Figure 4:
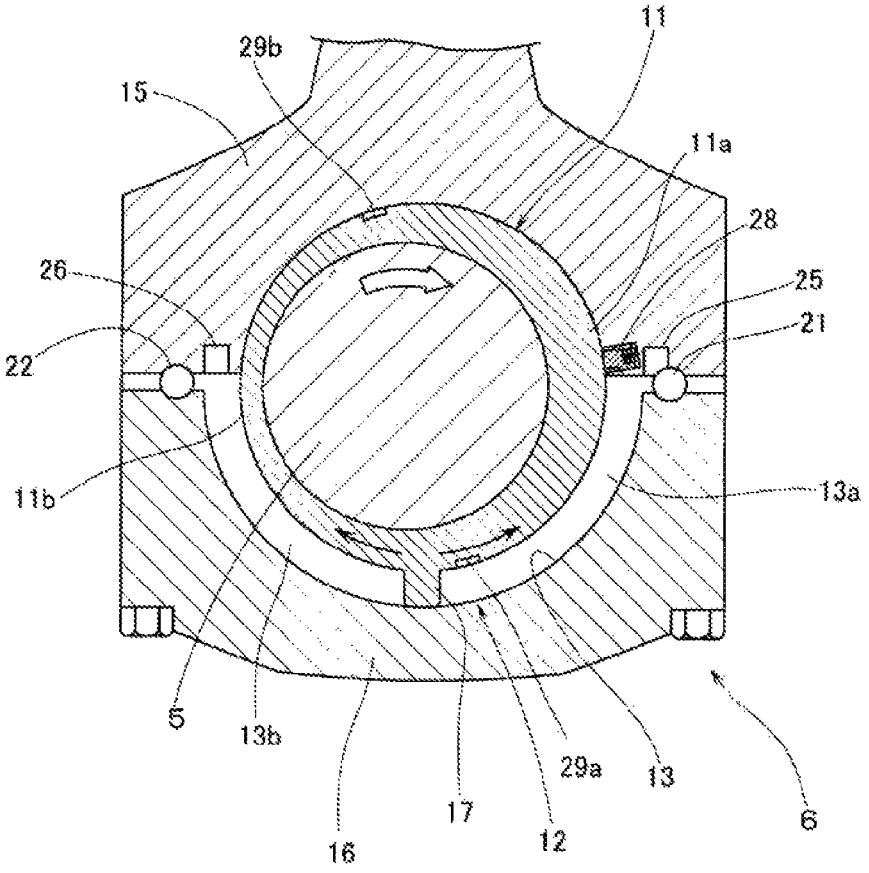
FIG. 4 is a cross-sectional view of a large end of the connecting rod.
Figure 5:
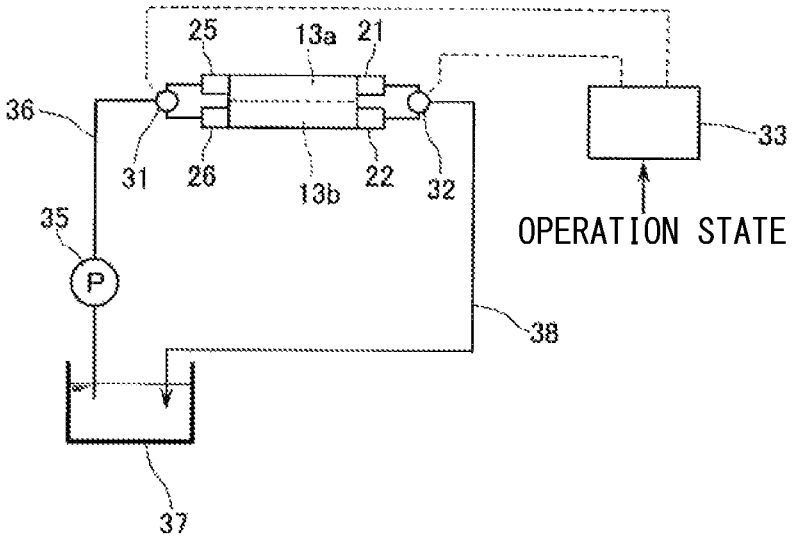
FIG. 5 is a schematic system diagram illustrating a pressure oil circuit.

FIG. 4 is a view illustrating a cross section of the large end of the connecting rod, and FIG. 5 is a schematic system diagram illustrating a pressure oil circuit.

As illustrated in FIGS. 2 and 4, the large end 6 of the connecting rod 10 is provided with a pressure oil chamber 13 for the actuator 12 that is driven and rotates the eccentric sleeve 11. That is, the large end 6 of the connecting rod includes a rod end portion 15 that is formed in an end portion of the connecting rod, and forms an upper half portion of the support hole (forms a semicircular body), and a semicircular cap 16 that forms a lower half portion of the support hole, and is fixed to the rod end portion 15.

The pressure oil chamber 13 is provided on an inner side (support hole) of the cap 16, and has a U-shaped cross section (refer to FIG. 2). The pressure oil chamber 13 is provided up to the circumferential opposite end portions on the inner side of the cap 16. That is, the pressure oil chamber 13 is formed in a portion except for split portions between the rod end portion 15 and the cap 16 in the large end 6 of the connecting rod 10.

Since the pressure oil chamber 13 is formed in a portion except for split portions between the rod end portion 15 and the cap 16 in the large end 6 of the connecting rod 10, it is possible to form a supply path and a discharge path for supplying and discharging pressure oil from the pressure oil chamber 13 in the split portion that is easy to machine. Since the pressure oil chamber 13 is formed in the cap 16, it is not necessary to form an pressure oil chamber in the rod end portion 15, and even when the pressure oil chamber 13 is provided in the large end 6, it is possible to maintain the rigidity of the large end 6 without reinforcing a boundary portion between the rod end portion 15 and a rod portion.

Since the pressure oil chamber 13 is provided up to the circumferential opposite end portions of the cap 16, the actuator 12 can be driven and rotates the eccentric sleeve 11 at an angle of approximately 180 degrees. For this reason, it is possible to set the amount of eccentricity of the eccentric sleeve 11 in a wide rotation range.

The pressure oil chamber 13 is formed up to the opposite end portions of the cap 16; however, depending on the amount of eccentricity of the eccentric sleeve, it is possible to form the pressure oil chamber having an arbitrary circumferential length in the cap 16. In addition, it is possible to provide the pressure oil chamber in the rod end portion 15, and it is possible to provide the pressure oil chamber across the cap 16 and the rod end portion 15. It is possible to provide the pressure oil chamber in the eccentric sleeve 11.

A vane 17, which acts as a transmitting unit, is provided in a boundary between the thick wall portion 11*a* and the thin wall portion 11*b* in an outer circumferential portion of the eccentric sleeve 11. The vane 17 is made to have a U shape corresponding to a cross-sectional shape of the pressure oil chamber 13, and is disposed in the pressure oil chamber 13. The pressure oil chamber 13 is divided into two chambers by the vane 17.

When pressure oil is supplied to a first chamber, and pressure oil is discharged from a second chamber, the eccentric sleeve 11 rotates in a first direction. In contrast, when pressure oil is supplied to the second chamber, and pressure oil is discharged from the first chamber, the eccentric sleeve 11 rotates in a second direction.

That is, the vane 17, which acts as the transmitting unit, works like the piston in the cylinder, and with the vane 17 interposed between the first and second chambers of the pressure oil chambers 13, the rotating position of the eccentric sleeve 11 is controlled by supplying pressure oil to the first chamber of the pressure oil chambers 13, by concurrently discharging pressure oil from the second chamber of the pressure oil chambers 13, and controlling the discharge state. In other words, the pressure oil chamber 13 and the vane 17 are built in the cap 16, form the actuator 12, and control the rotation position of the eccentric sleeve 11.

When the crankshaft 3 (refer to FIG. 1) rotates in a clockwise direction as illustrated in FIG. 4 (when the crank pin 5 rotates in a direction illustrated by a white arrow in FIG. 4), the thick wall portion 11*a* of the eccentric sleeve 11 rotates in the right half region as illustrated in FIG. 4, and is vertically disposed, and the thin wall portion 11*b* of the eccentric sleeve 11 rotates as illustrated in the left half region in FIG. 4, and is vertically disposed, and the vane 17 is disposed in the pressure oil chamber 13.

As illustrated in FIG. 4, when pressure oil is supplied to the pressure oil chamber (first pressure oil chamber 13*a*) positioned on the right side in FIG. 4, which is formed between the vane 17 and the vicinity of the thick wall portion 11*a*, and concurrently, pressure oil is discharged from the pressure oil chamber (second pressure oil chamber 13*b*) positioned on the left side in FIG. 4, which is formed between the vane 17 and the vicinity of the thin wall portion 11*b*, the engine is brought into a low compression ratio state in which the eccentric sleeve 11 rotates in the clockwise direction as illustrated in FIG. 4, and the thin wall portion 11*b* is positioned on the upper side.

That is, when the engine is switched from a high compression ratio state to a low compression ratio state, the eccentric sleeve 11 rotates in the direction of the action of the rotating force of the crankshaft 3 (refer to FIG. 1), and the eccentric sleeve 11 rotates at a high response speed.

In contrast, when pressure oil is supplied to the second pressure oil chamber 13*b*, and concurrently, pressure oil is discharged from the first pressure oil chamber 13*a*, the engine is brought into a high compression ratio state in which the eccentric sleeve 11 rotates in a counter-clockwise direction as illustrated in FIG. 4, that is, in the opposite direction of the rotation direction of the crankshaft 3 (refer to FIG. 1) and the thick wall portion 11*a* is positioned on the upper side.

That is, when the engine is switched from a low compression ratio state to a high compression ratio state, high responsiveness is not required, and thereby the eccentric sleeve 11 rotates in the opposite direction of the rotation direction of the crankshaft 3 (refer to FIG. 1).

As illustrated in FIG. 4, a fixing pin 28 is provided in the rod end portion 15 while being biased toward the support hole in a protruding manner. The fixing pin 28 is provided in the rod end portion 15 in a state where a tip end of the fixing pin 28 is in slide contact with the circumferential surface of the eccentric sleeve 11. A fitting groove 29 is formed in the outer circumferential surface of the eccentric sleeve 11, and the tip end of the fixing pin 28 is fitted into the fitting groove 29.

In a high compression ratio state in which the thick wall portion 11*a* of the eccentric sleeve 11 is positioned on the upper side, the fixing pin 28 faces a fitting groove 29*a* and is fitted into the fitting groove 29*a*, and the high compression ratio state is fixed. In a low compression ratio state in which the thin wall portion 11*b* of the eccentric sleeve 11 is positioned on the upper side, the fixing pin 28 faces a fitting groove 29*b* and is fitted into the fitting groove 29*b*, and the low compression ratio state is fixed.

When the compression ratio is changed, the fitting between the fixing pin 28 and one (fitting groove 29*a*) of the fitting grooves 29 is released using a mechanism (not illustrated). Then, the eccentric sleeve 11 rotates, and the fixing pin 28 is fitted into the other (fitting groove 29*b*) of the fitting grooves 29, and thereby the changed compression ratio is fixed.

Hereinafter, specifically, a mechanism for controlling the rotation of the eccentric sleeve 11 will be described with reference to FIGS. 1, 4, and 5.

As illustrated in FIGS. 4 and 5, a first discharge port 21 communicates with an end portion of the pressure oil chamber 13, which is positioned close to the first pressure oil chamber 13*a*, and a second discharge port 22 communicates with an end portion of the pressure oil chamber 13, which is positioned close to the second pressure oil chamber 13*b*. In addition, a first supply port 25 communicates with the end portion of the pressure oil chamber 13, which is positioned close to the first pressure oil chamber 13*a*, and a second supply port 26 communicates with the end portion of the pressure oil chamber 13, which is positioned close to the second pressure oil chamber 13*b*.

When the first discharge port 21 is closed, and pressure oil is supplied to the first pressure oil chamber 13*a* via the first supply port 25, pressure oil is discharged via the second discharge port 22, and the eccentric sleeve 11 rotates in the clockwise direction as illustrated in FIG. 4. When the second discharge port 22 is closed, and pressure oil is supplied to the second pressure oil chamber 13*b* via the second supply port 26, pressure oil is discharged via the first discharge port 21, and the eccentric sleeve 11 rotates in the counter-clockwise direction as illustrated in FIG. 4.

As illustrated in FIG. 5, a supply switching valve 31 is provided so as to switch the opening of the first supply port 25 and the second supply port 26. In addition, a discharge switching valve 32 is provided so as to switch the opening of the first discharge port 21 and the second discharge port 22. The switching of the supply switching valve 31 and the discharge switching valve 32 is controlled by commands from the control unit 33. The control unit 33 receives information on the operation state (a state of a high load operation at the low compression ratio, and a state of a low load operation at the high compression ratio).

That is, depending on the operation state of a vehicle, the switching of the supply switching valve 31 and the discharge switching valve 32 is controlled, and thereby pressure oil is supplied via the first supply port 25 or the second supply port 26, and pressure oil is discharged via the first discharge port 21 or the second discharge port 22. That is, the rotation direction of the eccentric sleeve 11 is controlled by the switching of the supply switching valve 31 and the discharge switching valve 32.

The supply switching valve 31 is connected to a pressure oil pump 35 via a supply path 36, and the discharge switching valve 32 is connected to a tank 37 via a discharge path 38.

As illustrated in FIG. 1, the supply switching valve 31 and the discharge switching valve 32 are disposed in a valve block 41 on a lower block 2 of the cylinder block. The supply and discharge of pressure oil is done via the crank journal 4 and the crank pin 5 of the crankshaft 3 from the valve block 41.

Hereinafter, specifically, the switching between the high compression ratio and the low compression ratio will be described with reference to FIGS. 6A to 7C.

Figures 6A, 6B, 6C:
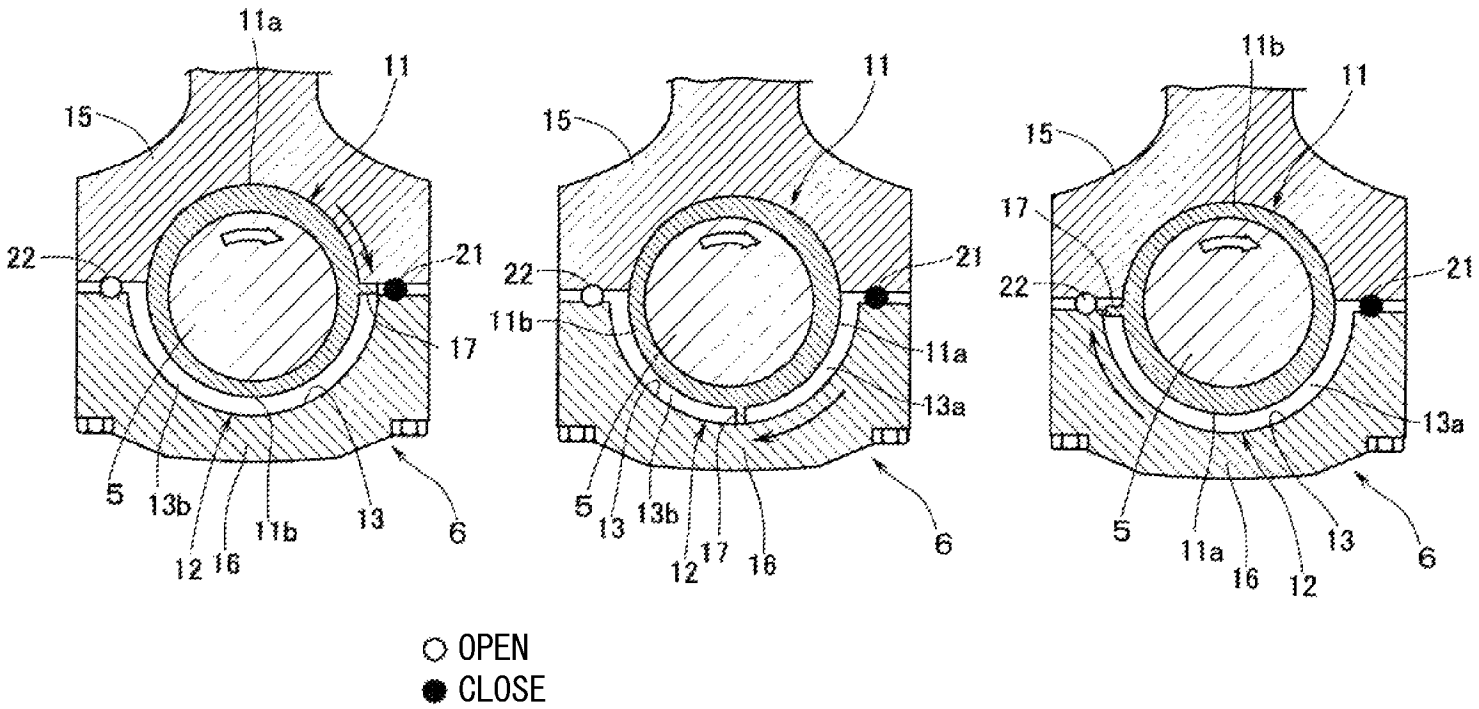
FIGS. 6A to 6C illustrate a switching operation from a high compression ratio state to a low compression ratio state.
Figures 7A, 7B, 7C:
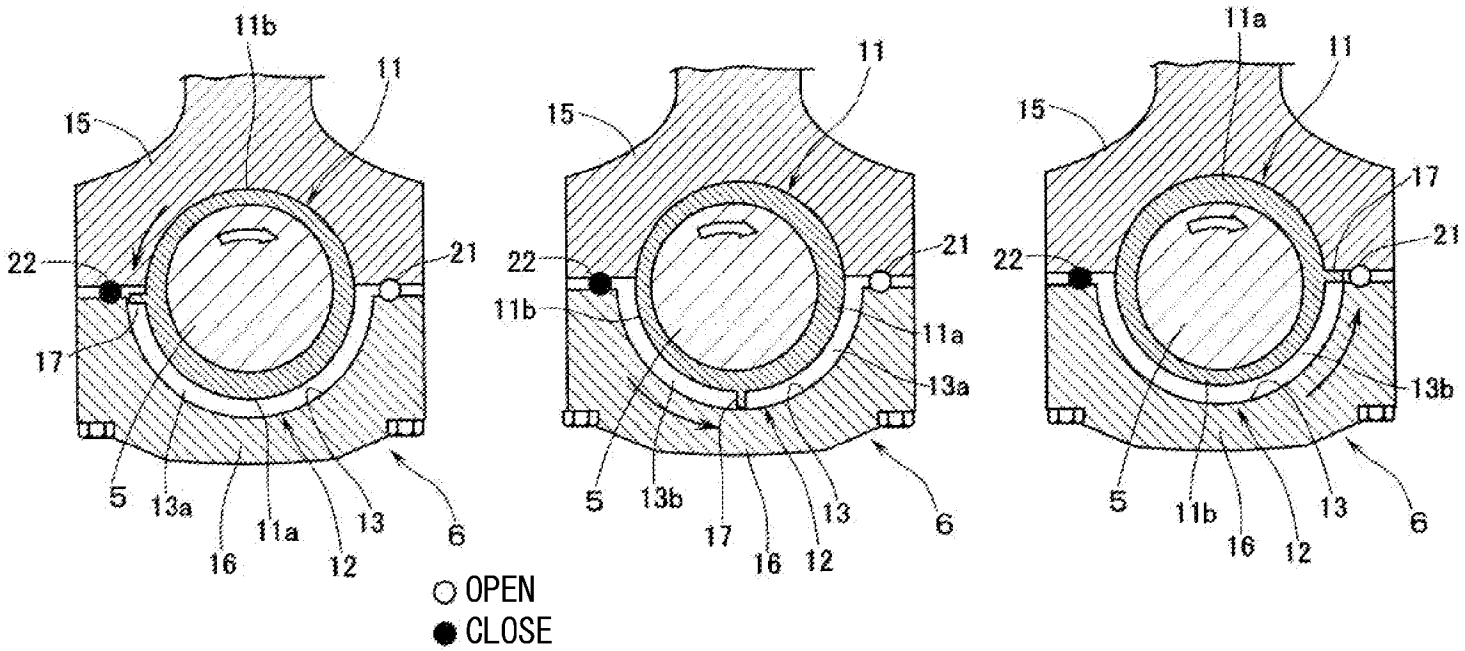
FIGS. 7A to 7C illustrate a switching operation from a low compression ratio state to a high compression ratio state.

FIGS. 6A to 6C illustrate a switching operation from a high compression ratio state to a low compression ratio state, and FIGS. 7A to 7C illustrates a switching operation from a low compression ratio state to a high compression ratio state. FIGS. 6A and 7A illustrate an operation state before the switching is completed, and FIGS. 6B and 7B illustrate an operation state in the process of the switching, and FIGS. 6C and 7C illustrate an operation state when the switching is completed.

As illustrated in FIG. 6A, in a high compression ratio state, in a state where the thick wall portion 11*a* is positioned on the upper side, and the vane 17 is positioned in the end portion as illustrated on the right side in FIG. 6A, the rotation position of the eccentric sleeve 11 is fixed, and the second pressure oil chamber 13*b* is filled with pressure oil. When the compression ratio is switched to the low compression ratio, the first discharge port 21 is closed, and the second discharge port 22 is opened. In this state, pressure oil is supplied to the first pressure oil chamber 13*a* via the first supply port 25.

As illustrated in FIG. 6B, pressure oil in the second pressure oil chamber 13*b* is discharged via the second discharge port 22, and the vane 17 is pushed due to an increase in the volume of the pressure oil in the first pressure oil chamber 13*a*, and the eccentric sleeve 11 rotates in the clockwise direction.

As illustrated in FIG. 6C, when pressure oil is continuously supplied to the first pressure oil chamber 13*a* via the first supply port 25, the entirety of the pressure oil in the second pressure oil chamber 13*b* is discharged via the second discharge port 22, and the vane 17 is pushed, and the eccentric sleeve 11 rotates in the clockwise direction. As a result, a state of the engine is brought into a low compression ratio state in which the thin wall portion 11*b* is positioned on the upper side.

Accordingly, when the engine is switched from a high compression ratio state to a low compression ratio state, the actuator 12 is driven and rotates the eccentric sleeve 11 in the direction of the action of a rotating force of the crankshaft 3 (refer to FIG. 1) (the rotation of the crank pin 5 in a direction of a white arrow).

As a result, when the engine is switched to a low compression ratio state which requires high responsiveness, it is possible to rotate the eccentric sleeve 11 at a high response speed.

As illustrated in FIG. 7A, in a low compression ratio state, in a state where the thin wall portion 11*b* is positioned on the upper side, and the vane 17 is positioned in the end portion on the left side in FIG. 7A, the rotation position of the eccentric sleeve 11 is fixed, and the first pressure oil chamber 13*a* is filled with pressure oil. When the compression ratio is switched to the high compression ratio, the second discharge port 22 is closed, and the first discharge port 21 is opened. In this state, pressure oil is supplied to the second pressure oil chamber 13*b* via the second supply port 26.

As illustrated in FIG. 7B, pressure oil in the first pressure oil chamber 13*a* is discharged via the first discharge port 21, and the vane 17 is pushed due to an increase in the volume of the second pressure oil chamber 13*b*, and the eccentric sleeve 11 rotates in the counter-clockwise direction.

As illustrated in FIG. 7C, when pressure oil is continuously supplied to the second pressure oil chamber 13*b* via the second supply port 26, the entirety of the pressure oil in the first pressure oil chamber 13*a* is discharged via the first discharge port 21, and the vane 17 is pushed, and the eccentric sleeve 11 rotates in the counter-clockwise direction. As a result, a state of the engine is brought into a high compression state in which the thick wall portion 11*a* is positioned on the upper side.

Accordingly, when the engine is switched from a low compression ratio state to a high compression ratio state that does not require high responsiveness, the actuator 12 is driven and rotates the eccentric sleeve 11 in the opposite direction of the rotation direction of the crankshaft 3 (refer to FIG. 1) (direction of rotation of the crank pin 5 illustrated by the white arrow).

As described above, in the variable compression ratio device for an internal combustion engine, since the actuator 12 (the actuator 12 supplying and discharging pressure oil from the pressure oil chamber 13) rotates the eccentric sleeve 11 using the vane 17, it is possible to make the position of the support hole of the large end 6 eccentric with the position of the crank pin 5, and it is possible to switch the position of the piston 8 to the position for the high compression ratio, or the position for the low compression ratio to be realized. For this reason, it is possible to reliably control the rotation position of the eccentric sleeve 11 to be in the position (desired rotation position) for the high compression ratio, or the position for the low compression ratio to be realized.

In the configuration illustrated in the embodiment, the actuator 12 supplies pressure oil to the pressure oil chamber 13, and rotates the eccentric sleeve 11 using the vane 17; however, it is possible to use an actuator that rotates the eccentric sleeve 11 using a rotary motor, or an actuator that rotates the eccentric sleeve 11 using electrical power.

In view of the above, according the present invention, the center axis of the support hole of the small end or the large end is displaced with respect to the center axis of the support shaft due to the rotation of the eccentric sleeve by the actuator, and the position of the piston is switched to a position for a high compression ratio or a position for a low compression ratio to be realized.

For this reason, it is possible to reliably control the rotation position of the eccentric sleeve to be in a desired rotation position.

According to the present invention, oil pressure is applied to the pressure oil chamber based on commands from the control unit, and thereby the eccentric sleeve rotates due to oil pressure transmitted via the transmitting unit (for example, a vane formed integrally with the eccentric sleeve).

The transmitting unit works like the piston in the cylinder, and with the transmitting unit interposed between first and second chambers of the pressure oil chambers, the rotating position of the eccentric sleeve is preferably controlled by supplying pressure oil to the first chamber of the pressure oil chambers, and by concurrently discharging pressure oil from the second chamber of the pressure oil chambers, and controlling the discharge state.

According to the present invention, it is possible to provide the pressure oil chamber in the large end of the connecting rod, and to rotate the eccentric sleeve using pressure oil. In addition, it is possible to provide the pressure oil chamber in the connecting rod or the eccentric sleeve.

According to the present invention, it is possible to provide the pressure oil chamber in the support hole (for example, an inner side of the cap, or an inner side of the rod end portion) of the large end of the connecting rod, and to rotate the eccentric sleeve using pressure oil.

The variable compression ratio device for an internal combustion engine of the present invention can reliably control the rotation position of the eccentric sleeve to be in a desired rotation position.

According to the present invention, a variable compression ratio device for an internal combustion engine can be applied to various industrial fields.

What is claimed is:

1. A variable compression ratio device for an internal combustion engine comprising:

a connecting rod, having a small end and a large end, wherein a support hole formed at the small end is pivotally supported by a support shaft of a piston that reciprocates in a cylinder, and a support hole formed at the large end is pivotally supported by a support shaft of a crankshaft;

an eccentric sleeve that is rotatably installed between the support hole of the small end or the support hole of the large end and the support shaft, and displaces a center axis of the support hole of the small end or a center axis of the support hole of the large end with respect to a center axis the support shaft; and an actuator that drives and rotates the eccentric sleeve, the actuator including a pressure oil chamber that is formed between the small end or the large end of the connecting rod, and the eccentric sleeve, and a transmitting unit for transmitting oil pressure applied to the pressure oil chamber to the eccentric sleeve, wherein the small end or the large end of the connecting rod comprises a rod end portion and a cap attached to the rod end portion, the rod end portion and the cap forming the support hole in which the eccentric sleeve is provided, and wherein the pressure oil chamber is provided up to circumferentially opposite end portions of the cap so that a supply path for supplying oil into the pressure oil chamber and a discharge path for discharging the oil from the pressure oil chamber are provided in a split portion between the rod end portion and the cap of the connecting rod.

2. The variable compression ratio device for an internal combustion engine according to claim 1, further comprising:

a control unit for controlling the rotation of the eccentric sleeve by controlling the oil pressure applied to the pressure oil chamber.

3. The variable compression ratio device for an internal combustion engine according to claim 2, wherein the eccentric sleeve is disposed between the support hole of the large end of the connecting rod and the support shaft of the crankshaft.

4. The variable compression ratio device for an internal combustion engine according to claim 3, wherein the pressure oil chamber is formed in the support hole of the large end of the connecting rod.

5. A variable compression ratio device for an internal combustion engine comprising:

a connecting rod, having a small end and a large end, wherein a support hole formed at the small end is pivotally supported by a support shaft of a piston that reciprocates in a cylinder, and a support hole formed at the large end is pivotally supported by a support shaft of a crankshaft;

an eccentric sleeve that is rotatably installed between the support hole of the small end or the support hole of the large end and the support shaft, and displaces a center axis of the support hole of the small end or a center axis of the support hole of the large end with respect to a center axis of the support shaft; and an actuator that drives and rotates the eccentric sleeve, wherein a pin is provided to protrude from an inner surface of the support hole in which the eccentric sleeve is provided, and the eccentric sleeve comprises a groove into which the pin is fitted.

* * * * *